United States Patent [19]

Heffel

[11] 4,279,436

[45] Jul. 21, 1981

[54] DOOR LOCK GUARD PROTECTOR

[76] Inventor: Harold Heffel, 7 Iota Pl., Saginaw, Mich. 48603

[21] Appl. No.: 737,538

[22] Filed: Nov. 1, 1976

[51] Int. Cl.[3] ..... E05C 21/00

[52] U.S. Cl. ..... 292/346

[58] Field of Search ..... 248/205 A; 292/346; 70/416, 418

[56] References Cited

U.S. PATENT DOCUMENTS

| | | | |
|---|---|---|---|
| 525,074 | 8/1894 | Gray | 292/346 |
| 1,091,453 | 3/1914 | Fletcher | 292/346 X |
| 2,679,373 | 5/1954 | Henley | 248/205 A X |
| 3,279,840 | 10/1966 | Barone | 292/346 |
| 3,728,665 | 4/1973 | Frey | 339/97 C |

*Primary Examiner*—Richard E. Moore

*Attorney, Agent, or Firm*—John J. Swartz

[57] ABSTRACT

A door lock guard attachment for use with a door frame and a door provided with a lock having a movable bolt. The lock guard attachment comprises a one piece, elongate L-shaped member having a mounting flange for attachment to either the door or the door frame, and an integral, abuttment flange for abutting a stop rail on the door frame. The inner face of the mounting flange has a plurality of longitudinally and laterally disposed inwardly projecting teeth for impeding the passage of a burglary tool between the door and the door frame.

3 Claims, 7 Drawing Figures

FIG. 1
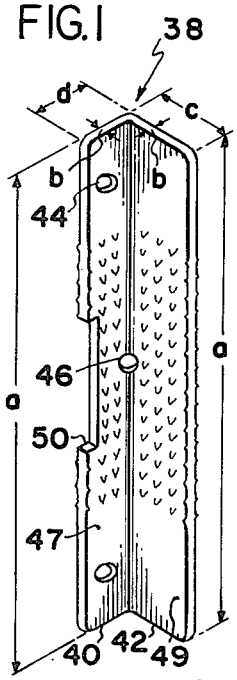
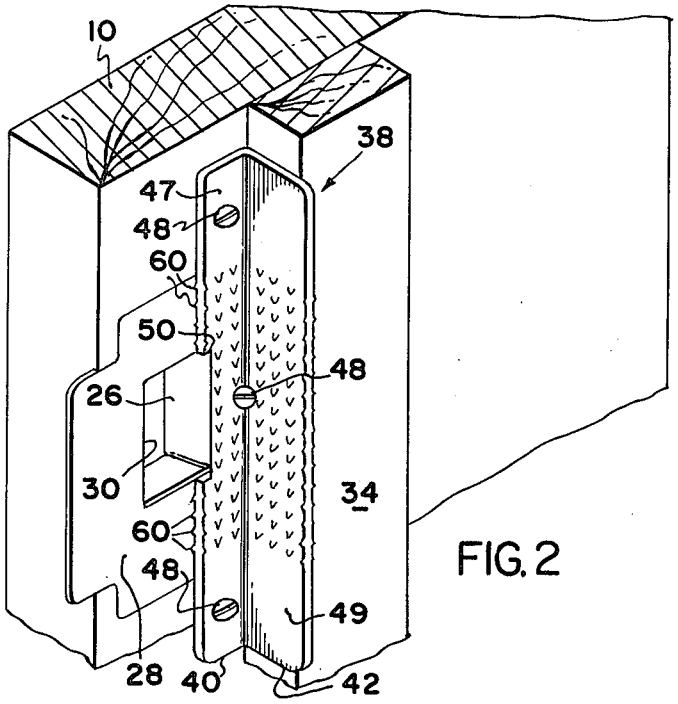
FIG. 2
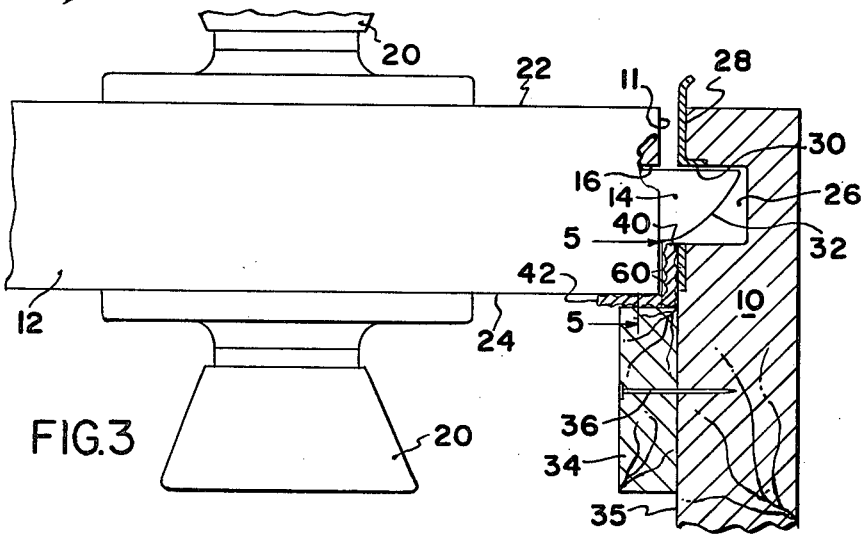
FIG. 3
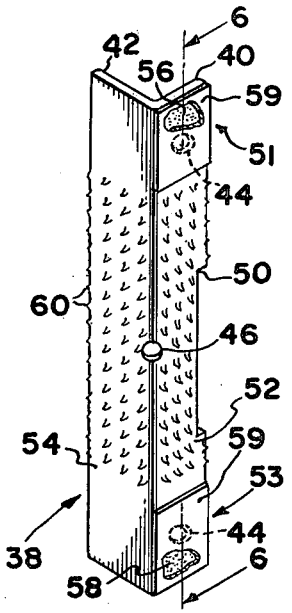
FIG. 4
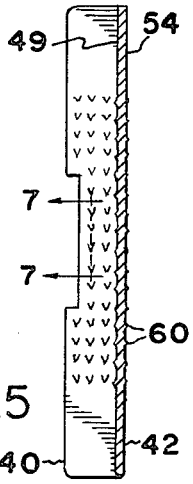
FIG. 5
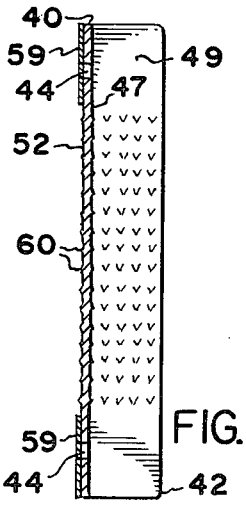
FIG. 6
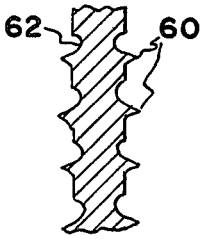
FIG. 7

DOOR LOCK GUARD PROTECTOR

BACKGROUND OF THE INVENTION

This invention relates to a guard for protecting a door lock, which locks a swingable door to a door frame and more particularly to a door lock guard which will impede the passage of a burglary tool between the door guard and the adjacent portion of the door and door frame.

Many door lock guards for latch bolts have been provided heretofore for attempting to inhibit the unauthorized opening of a locked door via a flat burglar's blade which is slipped under or past a loosened or removed door stop. Once the prior art door guard is installed, the guard itself presents a smooth surface which will permit a flat bladed instrument to easily slide thereon without any substantial resistance.

Accordingly, an object of the present invention is to provide an effective impediment to the passage of a flat burglary card along the surface of a guard device by the provision of a guard device which has a jagged surface that resists such sliding movement.

Although a door tightly abuts a vertical stop rail on the door jamb when the door is closed to inhibit a jimmy forcing the door apart from its jamb sufficiently to allow the latch bolt to be forced over the strike plate, doors sometimes warp and do not close tightly against the rail stop. A burglar can insert a thin flat card between the door and the jamb at the warped portion of the door and then move the flexible jimmy card vertically to a position overlying the latching bolt to force the latching bolt to a retracted position.

Accordingly, it is another object of the present invention to provide a door guard which will deter such unauthorized, surreptitious access and tampering.

Accordingly, it is another object of the present invention to provide a lock guard which is L-shaped in cross section and has a dentated surface providing a plurality of teeth defining an uneven surface that impedes the passage of a flat burglary plate or card in the vertical and horizontal directions.

Other objects and advantages of the present invention will become apparent to those of ordinary skill in the art as the description thereof proceeds.

SUMMARY OF THE INVENTION

A door lock guard protector including an elongate L-shaped member including an attachment flange having an outer face for mounting on a door frame and an abuttment flange for abutting a stop rail against which the door closes, at least the inner face of said mounting flange being jagged and uneven to inhibit passage of a burglars blade.

The invention may be more readily understood by reference to the accompanying drawings in which:

FIG. 1 is a perspective view illustrating a door lock guard constructed according to the present invention;

FIG. 2 is a perspective view illustrating the door lock guard of the present invention mounted on a door jamb;

FIG. 3 is a sectional plan view illustrating a door in the closed position abutting a stop rail and the door lock guard illustrated in FIG. 2;

FIG. 4 is a rear elevational perspective view of the door lock guard illustrated in FIG. 1;

FIG. 5 is a sectional view, taken along the line 5—5 of FIG. 3, illustrating only the door lock guard;

FIG. 6 is a sectional view, taken along the line 6—6 of FIG. 4, but illustrating only the door lock guard; and FIG. 7 is a greatly enlarged, sectional plan view taken along the line 7—7 of FIG. 5.

Apparatus constructed according to the present invention is particularly adapted for use with a door jamb, one side of which is illustrated at 10, swingably mounting a door 12 via hinges (not shown) for swinging movement between an open position and the closed position illustrated in FIG. 2. The unhinged or free lateral edge 11 of the door 10 mounts a laterally extending latching bolt 14 which is laterally movable in a suitable aperture 16 provided in the free edge 11 of the door 12, to and from a latching position by inner and outer door knobs or handles 20 which are rotatably mounted on the inner and outer sides 22 and 24 of the door 12, as usual.

The door jamb 10 includes a bolt receiving recess 26 for receiving the bolt 14 in the extended, latching position. A strike plate 28 is mounted on the vertical face of the door jamb 10 and includes an opening 30 in alignment with the door jamb opening 26. The latching bolt 14 includes an inclined cam face 32 for engaging the strike plate 28 to cam the bolt 14 to a retracted position as the door is swung to a closed position, as usual. As the bolt reaches the strike plate opening 30 and the door jamb recess 26, it will be spring biased to the extended position illustrated in FIG. 3. A bolt lock (not shown) is provided on the inner door knob 20 for selectively preventing retraction of the bolt if the outer knob 20 is attempted to be rotated.

A vertical door stop or stop rail 34 is mounted on the vertical surface 35 of the door jamb 10 against which the door 12 generally abuts when it is in the closed position illustrated in FIG. 3. The stop 34 is mounted on the face of the jamb 10 via a plurality of vertically spaced nails 36.

In the past, burglars have gained unauthorized access to the inside of the room by slipping a burglary tool, alternatively referred to as a pry bar, a burglars plate, or a burglars blade between the free end 11 of the door and the inside of the door jamb 10, against the cam face 32 of the door bolt to force the bolt 14 to a retracted position. Likewisely, burglars have also loosened or partially removed the door stop 34 and slipped the burglars plate between the door jamb 34 and the door jamb face 35 to force the bolt 14 to a retracted position.

A door lock guard protector assembly constructed according to the present invention is generally designated 38 and comprises a one-piece, right angle channel 38 which is L-shaped in cross section and has a mounting flange 40 and a right angularly related abuttment flange 42. The flanges 40 and 42 have the same longitudinal extent a and the same thickness b, however, the width c of the abuttment flange 42 is slightly greater than the width d of the mounting flange 40. The mounting flange 40 includes vertically spaced apertures 44 and 46 for receiving mounting screws 48.

The flange 40 has a vertically, elongated recess 50 extending inwardly from the free, terminal edge thereof. The recess 50 is of a length so as to accommodate the strike plate opening 30 in the strike plate 28. The vertical height a of the lock guard is substantially greater than the vertical height of the keeper or strike plate 28 with which it is used so as to extend a distance both vertically above and below the strike plate 28 when it is installed as illustrated in FIG. 2.

The upper and lower ends 51 and 53 of the outer or back surface 52 of the mounting flange 40 is coated with adhesive layers 56 and 58 respectively. The layers 56 and 58 are, prior to use, normally protected by a removable covering 59 which, when removed, exposes the sticky adhesive material 56 and 58 to assist the user in mounting the device on the door jamb or the door as will be explained more particularly hereinafter.

The remainder of the back or outer surface 52 of the mounting flange 40, the back or outer surface 54 of the abuttment flange 42 and the inside or front surfaces 47 and 49 of the flanges 40 and 42 respectively is marked by a plurality of longitudinally and laterally spaced spurs, points, prickles, teeth or sharp projections 60 immediately adjacent a like number of recesses, indentations or depressions 62 to present a broken, uneven, spiked, prickley, jagged or denticulated surface. As is best illustrated in FIG. 7, the teeth 60 project unequal distances from the surfaces 52, 54, 47, 49 to resist the passage of a burglars tool therealong. The recesses 62 and teeth 60 are formed with a denticulating tool (not shown) which deforms the surface material to form the cavities 62 and concurrently moves the surface material outwardly to form the sharp projections 60.

As is illustrated in FIG. 2, the door guard 38 is mounted on the vertical surface of the door jamb 10 via screws 48. The user first removes the backing or protector plate 62. The door guard 38 is initially positioned on the door jamb adjacent the door strike plate 28 such that the vertical recess 50 is longitudinally aligned with the strike opening 30 in the strike plate 28 and the opening 36 in the door jamb 10. The user then presses the mounting flange 40 and the adhesive layer 58 against the vertical surface of the door jamb to temporarily hold the door guard 38 in position while the user is readying the screws 48 for insertion into the mounting flange apertures 44 and 46.

If a burglar inserts a flat blade between the surface 24 of the door 12 and the mounted door guard assembly 38, the projections or teeth 60 on the flange 42 and flange 40 will resist such passage and inhibit the passage of the blade to the bolt 14. If the burglar attempts to pass the flat plate between the stop rail 34 and the jamb 10, it will engage the jagged surface 52 and the passage of the burglar blade will be deterred.

It is to be understood that the drawings and descriptive matter are in all cases to be interpreted as merely illustrative of the principles of the invention , rather than as limiting the same in any way, since it is contemplated that various changes may be made in various elements to achieve like results without departing from the spirit of the invention or the scope of the appended claims.

What I claim is:

1. In combination:

a hinged door;

a door frame having a stop rail, against which said door closes, and a bolt receiving opening therein;

said door having a lock with a retractable bolt engageable in said jamb by extending out of a free end face of said door into said opening;

a door lock guard comprising:

an elongate body, being L-shaped in cross section, including a mounting flange having an outer surface for attachment to one of said door frame and said door and an inner surface lying in a predetermined plane; and an abuttment flange integral with, and at right angles to, said mounting flange, for abutting a portion of said stop rail when said door closes; and means for mounting said body on one of said door and said frame adjacent said bolt;

said mounting flange including an impermeable portion laterally, adjacent said opening, having a plurality of projections projecting beyond said plane toward said door to impede the passage of a burglary tool between said door guard and said one of said door frame and said door;

said projections comprising a plurality of longitudinally and laterally spaced teeth projecting therefrom;

said inner surface including a plurality of recesses immediately adjacent said teeth;

said teeth projecting unequal distances from said inner surface.

2. In combination:

a hinged door;

a door frame having a stop rail, against which said door closes, and a bolt receiving opening therein;

said door having a lock with a retractable bolt engageable in said jamb by extending out of a free end face of said door into said opening;

a door lock guard comprising:

an elongate body, being L-shaped in cross section, including a mounting flange having an outer surface for attachment to one of said door frame and said door and an inner surface lying in a predetermined plane; and an abuttment flange integral with, and at right angles to, said mounting flange, for abutting a portion of said stop rail when said door closes; and means for mounting said body on one of said door and said frame adjacent said bolt;

said mounting flange including an impermeable portion laterally, adjacent said opening, having a plurality of projections projecting beyond said plane toward said door to impede the passage of a burglary tool between said door guard and said one of said door frame and said door;

said outer surface having a plurality of longitudinally and laterally disposed projecting teeth.

3. The combination set forth in claim 2 wherein said abuttment flange includes inner and outer surfaces, each having a plurality of teeth projecting therefrom to impede the passage of a burglar's tool.

* * * * *